US007327319B2

(12) United States Patent
Hirabayashi

(10) Patent No.: US 7,327,319 B2
(45) Date of Patent: Feb. 5, 2008

(54) ANTENNA DEVICE, RADIO DEVICE, AND ELECTRONIC INSTRUMENT

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/544,067

(22) PCT Filed: Dec. 15, 2004

(86) PCT No.: PCT/JP2004/019146

§ 371 (c)(1),
(2), (4) Date: Aug. 2, 2005

(87) PCT Pub. No.: WO2005/062418

PCT Pub. Date: Jul. 7, 2005

(65) Prior Publication Data

US 2006/0050000 A1 Mar. 9, 2006

(30) Foreign Application Priority Data

Dec. 19, 2003 (JP) ..... 2003-423851

(51) Int. Cl.
*H01Q 1/24* (2006.01)

(52) U.S. Cl. ..... 343/702

(58) Field of Classification Search ..... 343/702, 343/700 MS, 725, 767
See application file for complete search history.

(56) References Cited

U.S. PATENT DOCUMENTS 5,442,367 A * 8/1995 Naito et al. ..... 343/700 MS
5,828,341 A * 10/1998 Delamater ..... 343/702
5,990,838 A * 11/1999 Burns et al. ..... 343/702
6,204,825 B1 * 3/2001 Wilz ..... 343/841
6,703,981 B2 * 3/2004 Meitzler et al. ..... 343/755
6,788,266 B2 * 9/2004 St. Hillaire et al. ..... 343/770
6,930,639 B2 * 8/2005 Bauregger et al. ... 343/700 MS
2002/0180646 A1 12/2002 Kivekas et al.

FOREIGN PATENT DOCUMENTS

| | | |
|---|---|---|
| EP | 1 233 426 A2 | 8/2002 |
| GB | 2 388 744 | 11/2003 |
| JP | 58-141006 | 8/1983 |
| JP | 6-310167 | 11/1994 |
| JP | 2002-246839 | 8/2002 |
| JP | 2003-8308 | 1/2003 |
| JP | 2003-124729 | 4/2003 |

OTHER PUBLICATIONS

Title: The Illustrated Dictionary of Electronics□□Author: Gibilisco, Stan.□□Publication: New York McGraw-Hill Professional, 2001.□□p. 767□□eBook ISBN: 0071389660□□ISBN: 0071389660□□Subject: Electronics-Dictionaries.□□Language: English□□□□.*
U.S. Appl. No. 10/545,313, filed Aug. 12, 2005, Hirabayashi.
U.S. Appl. No. 10/544,067, filed Aug. 2, 2005, Hirabayashi.

* cited by examiner

*Primary Examiner*—Hoang V. Nguyen
*Assistant Examiner*—Robert Karacsony
(74) *Attorney, Agent, or Firm*—Oblon, Spivak, McClelland, Maier & Neustadt, P.C.

(57) ABSTRACT

An antenna apparatus 2 has a separator 23; solid electrolytic layers 24*a* and 24*b* disposed on both sides of the separator 23; and linear antennas 22*a* and 22*b* disposed on the solid electrolyte layers 24*a* and 24*b*, respectively, and made of an electroconductive polymer. When a DC voltage is applied between the antenna patterns 22*a* and 22*b*, ions can be doped to one of the antenna patterns 22*a* and 22*b* and ions can be undoped from the other. In other words, one of the antenna patterns 22*a* and 22*b* can become a conductor, whereas the other can become an insulator.

27 Claims, 14 Drawing Sheets

ANTENNA DEVICE, RADIO DEVICE, AND ELECTRONIC INSTRUMENT

TECHNICAL FIELD

The present invention relates to an antenna apparatus having a plurality of antennas; a wireless apparatus therewith; and an electronic apparatus therewith.

BACKGROUND ART

In recent years, a wireless communication function has been mounted on not only information processing devices, such as personal computers, and communication terminal devices, such as cellular phones and PDAs (Personal Digital Assistances), but also various types of consumer electronic devices, such as audio devices, video devices, camera devices, printers, and entertainment robots. In addition, the wireless communication function has been mounted on wireless LAN (Local Area Network) access points and small accessory cards. The accessory cards are wireless card modules having both a storage function and a wireless communication function. Known as wireless card modules are for example PCMCIA (Personal Computer Memory Card International Association) type cards, compact flash cards (registered trademark), mini PCI (Peripheral Component Interconnection) cards.

As the wireless communication function has been mounted on various devices, antennas that receive and transmit radio waves have needed various shapes and characteristics. For example, antennas that can select radiations of polarized waves have been needed.

In a real operational environment of a wireless apparatus, because of for example reflection of radio waves by buildings and substances, the radio waves are propagated with various planes of polarized waves. To solve such a problem, so-called polarization diversity that transmits and receives a radio wave by changing the polarization of the antenna for optimal data transmission rate and throughput has been proposed (for example, Japanese Patent Laid-Open Publication No. 2002-92576).

FIG. 13 is a plan view showing a polarization diversity wireless apparatus using two dipole antennas. Disposed on substrates 101*a* and 101*b* are dipole antennas 102*a* and 102*b*, respectively. The substrates 101*a* and 101*b* are disposed in the apparatus so that the dipole antennas 102*a* and 102*b* are orthogonally arranged. The dipole antenna 102*a* is connected to a terminal 104*c* of a switch 104 through a balance-unbalance converter (balun) 103*a*. The dipole antenna 102*b* is connected to a terminal 104*b* of the switch 104 through a balance-unbalance converter (balun) 103*b*. A radio frequency is supplied to a terminal 104*a* of the switch 104.

FIG. 14 is a plan view showing a polarization diversity wireless apparatus using two Zepp antennas. Disposed on substrates 111*a* and 111*b* are Zepp antennas 112*a* and 112*b*, respectively. The substrates 111*a* and 111*b* are disposed in the apparatus so that the Zepp antennas 112*a* and 112*b* are orthogonally arranged. The Zepp antenna 112*a* is connected to a terminal 113*c* of a switch 113. The dipole antenna 112*b* is connected to a terminal 113*b* of the switch 113. A radio wave is supplied to a terminal 113*a* of the switch 113.

FIG. 15 is a plan view showing a polarization diversity wireless apparatus using two monopole antennas. Disposed on substrates 121*a* and 121*b* are monopole antennas 122*a* and 122*b* and base plates 123*a* and 123*b*, respectively. The substrates 121*a* and 121*b* are disposed in the apparatus so that the monopole antennas 122*a* and 122*b* are orthogonally arranged. The monopole antenna 122*a* is connected to a terminal 124*c* of a switch 124. The monopole antenna 122*b* is connected to a terminal 124*b* of the switch 124. The base plates 123*a* and 123*b* are grounded. A radio frequency wave is supplied to a terminal 124*a* of the switch 124.

In the polarization diversity wireless apparatuses shown in FIG. 13 to FIG. 15, when the reception level of one antenna becomes low, the other antenna is selected using the switches 104, 113, and 124 to prevent the quality of the received signal from deteriorating.

As described above, to ideally deal with propagation of a plurality of polarized waves, a plurality of antennas corresponding to various directions of polarized waves are disposed in one apparatus. In this method, however, it is necessary to orthogonally arrange the plurality of antennas. Thus, the area that the antennas occupy becomes large. As a result, the size of the apparatus becomes large. If the antennas are closely disposed in a small occupied area, the antennas interfere with each other. As a result, the radiation patterns of the antennas get distorted.

To solve the foregoing problem, it is thought that a circularly polarized wave micro-strip antenna is used instead of linearly polarized wave antennas that are orthogonally arranged. In this method, with one antenna, polarized waves can be selectively radiated. However, generally, the frequency band of a micro-strip antenna is narrow. For example, the bandwidth of a dipole antenna is around ten percent, whereas the bandwidth of a micro-strip antenna is several percent or less. Although the frequency band of a micro-strip antenna may be widened with parasitic elements, they cause the size of the apparatus to increase.

As described above, conventionally, it is difficult to decrease the area of a plurality of antennas of a polarization diversity wireless apparatus and suppress deterioration of characteristics of the antennas due to interference therebetween. Because of these difficulties, the polarization diversity wireless apparatus is inconsistent with the current engineering tendency of which a wireless apparatus is miniaturized and a wireless communication function is mounted on various consumer devices.

Therefore, an object of the present invention is to provide an antenna apparatus having a plurality of antennas that transmit and/or receive orthogonally polarized waves, and that are closely disposed, and that suppress deterioration of characteristics due to interference therebetween and to provide a wireless apparatus and an electronic apparatus that have the antenna apparatus.

DISCLOSURE OF THE INVENTION

To solve the foregoing problem, the first invention is an antenna apparatus, comprising:

a substrate; and a plurality of antenna patterns disposed on the substrate to transmit and/or receive polarized waves that are orthogonal to each other, wherein the substrate is made of a solid electrolyte, and wherein the antenna patterns are made of an electroconductive plastic.

In the first invention, the substrate typically has a planer shape and the plurality of antennas are typically disposed on both principal surfaces of the substrate. The plurality of antennas are typically disposed so that the substrate is interposed therebetween.

In the first invention, the antenna patterns are typically linear antennas. The linear antennas are typically Zepp antennas. In the first invention, the plurality of antenna patterns are typically at least one linear antenna and at least one slot antenna. The linear antenna is typically a Zepp antenna. The linear antenna is typically disposed in a slot of the slot antenna. In the first invention, the plurality of antenna patterns are typically two linear antennas and one slot antenna.

According to the first invention, a plurality of antenna patterns made-of an electroconductive plastic are disposed on a solid electrolyte so that orthogonally polarized waves are transmitted and/or received. Thus, when a DC voltage is applied between the plurality of antenna patterns, ions can be doped from the substrate to an antenna pattern having one potential and ions can be undoped from another antenna pattern having the other potential to the substrate. In other words, with a potential difference between the antenna patterns, the antenna pattern having one potential can become a conductor, whereas the antenna pattern having the other potential can become an insulator.

The second invention is a wireless apparatus that is connected to a main body of a device and that additionally provides a wireless function to the device, the wireless apparatus comprising:

a substrate;

a plurality of antenna patterns disposed on the substrate to transmit and/or receive polarized waves that are orthogonally to each other; and a switch that selects two groups from the plurality of antenna patterns so that the first group has one potential and the second group has another potential with a DC voltage applied between the plurality of antenna patterns, wherein the antenna patterns are made of an electroconductive plastic, and wherein the substrate is made of a solid electrolyte.

In the second invention, the substrate typically has a planer shape and the plurality of antennas are typically disposed on both principal surfaces of the substrate. The plurality of antennas are typically disposed so that the substrate is interposed therebetween.

In the second invention, the antenna patterns are typically linear antennas. The linear antennas are typically Zepp antennas. In the first invention, the plurality of antenna patterns are typically at least one linear antenna and at least one slot antenna. The linear antenna is typically a Zepp antenna. The linear antenna is typically disposed in a slot of the slot antenna. In the first invention, the plurality of antenna patterns are typically two linear antennas and one slot antenna.

According to the second invention, a plurality of antenna patterns made of an electroconductive plastic are disposed on a solid electrolyte so that orthogonally polarized waves are transmitted and/or received. Thus, when a DC voltage is applied between the plurality of antenna patterns, ions can be doped from the substrate to an antenna pattern having one potential and ions can be undoped from another antenna pattern having the other potential to the substrate. In other words, with a potential difference between the antenna patterns, the antenna pattern having one potential can become a conductor, whereas the antenna pattern having the other potential can become an insulator.

The third invention is an electronic apparatus that has a wireless communication function that transmits and receives information, the electronic apparatus comprising:

a substrate;

a plurality of antenna patterns disposed on the substrate to transmit and/or receive polarized waves that are orthogonally to each other;

a voltage source that applies a DC voltage between the plurality of antenna patterns; and a switch that selects two groups from the plurality of antenna patterns so that the first group has one potential and the second group has another potential with the DC voltage applied between the plurality of antenna patterns, wherein the antenna patterns are made of an electroconductive plastic, and wherein the substrate is made of a solid electrolyte.

In the third invention, the substrate typically has a planer shape and the plurality of antennas are typically disposed on both principal surfaces of the substrate. The plurality of antennas are typically disposed so that the substrate is interposed therebetween.

In the third invention, the antenna patterns are typically linear antennas. The linear antennas are typically Zepp antennas. In the first invention, the plurality of antenna patterns are typically at least one linear antenna and at least one slot antenna. The linear antenna is typically a Zepp antenna. The linear antenna is typically disposed in a slot of the slot antenna. In the first invention, the plurality of antenna patterns are typically two linear antennas and one slot antenna.

According to the third invention, a plurality of antenna patterns made of an electroconductive plastic are disposed on a solid electrolyte so that orthogonally polarized waves are transmitted and/or received. Thus, when a DC voltage is applied between the plurality of antenna patterns, ions can be doped from the substrate to an antenna pattern having one potential and ions can be undoped from another antenna pattern having the other potential to the substrate. In other words, with a potential difference between the antenna patterns, the antenna pattern having one potential can become a conductor, whereas the antenna pattern having the other potential can become an insulator.

As described above, according to the present invention, when a DC voltage is applied between a plurality of antenna patterns, ions can be doped from the substrate to an antenna pattern having one potential and ions can be undoped from another antenna pattern having the other potential to the substrate. In other words, with a potential difference between the antenna patterns, the antenna pattern having one potential can become a conductor, whereas the antenna pattern having the other potential can become an insulator. Thus, a plurality of antennas that transmit and/or receive orthogonally polarized waves can be closely disposed and deterioration of characteristics due to interference therebetween can be suppressed.

BEST MODES FOR CARRYING OUT THE INVENTION

Figure 1:
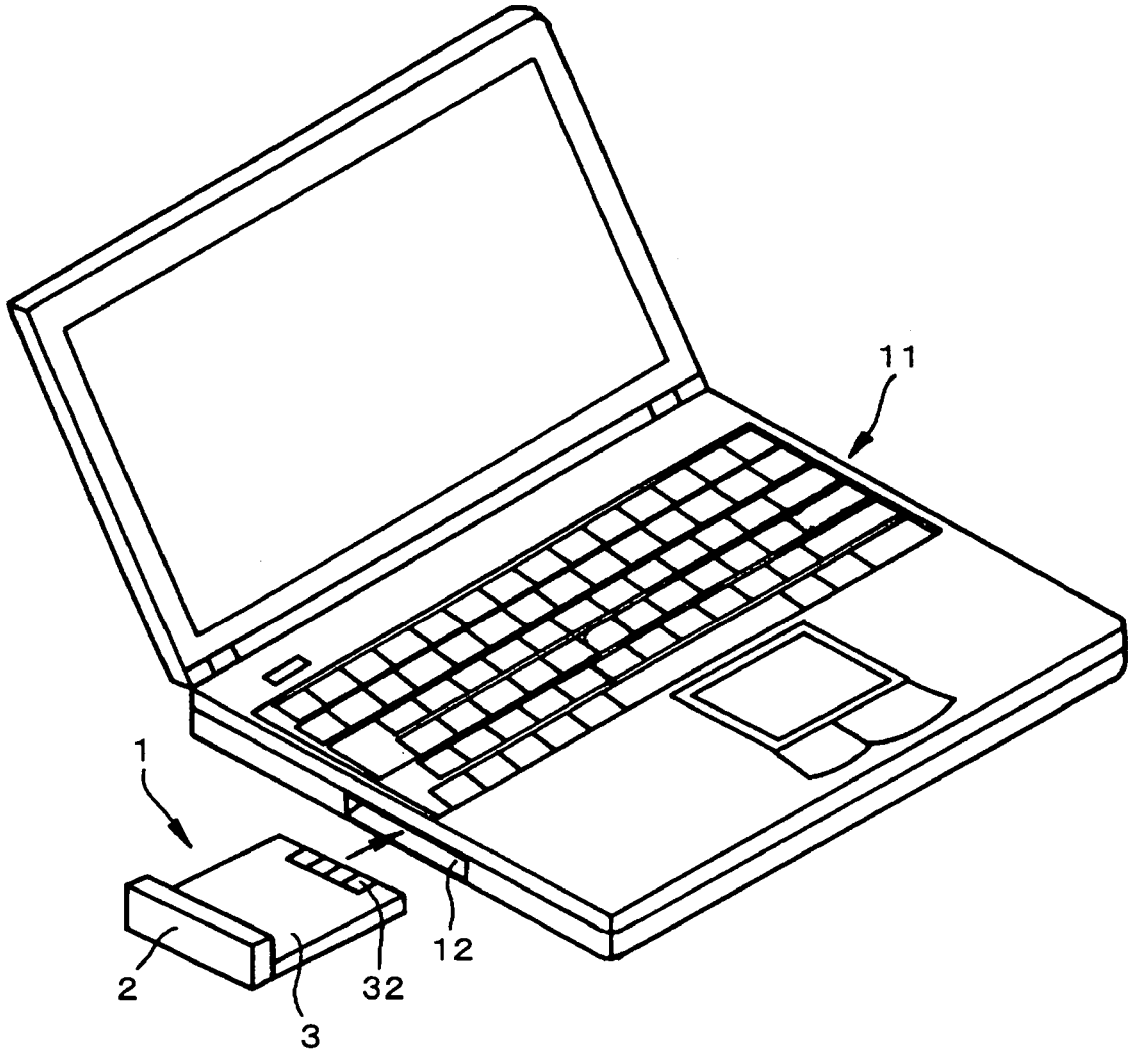
FIG. 1 is a perspective view showing an example of an electronic apparatus to which a wireless apparatus according to a first embodiment of the present invention is attached.

Next, with reference to the accompanying drawings, embodiments of the present invention will be described. In all the drawings of the embodiments, similar or corresponding elements are denoted by similar or corresponding reference numerals.

First, a first embodiment of the present invention will be described. FIG. 1 shows an example of an electronic apparatus to which a wireless apparatus according to the first embodiment of the present invention is attached. A wireless apparatus 1 is composed of a wireless apparatus main body 3 and an antenna apparatus 2 disposed at one end of the wireless apparatus main body 3. The wireless apparatus 1 is a wireless card module that has for example a storage function and a wireless communication function. The wireless card module is for example a PCMCIA type card, a compact flash card (registered trademark), or a mini PCI card. The present invention can be suitably applied to an antenna apparatus, a wireless apparatus, and an electronic apparatus that perform the polarization diversity or MIMO (Multi Input Multi Output) transmission.

The wireless apparatus 1 has a structure that can be freely attached to and detached from a slot 12 disposed in an electronic apparatus 11 such as a personal computer. Specifically, as shown in FIG. 1, the wireless apparatus 1 is attached to the slot 12 so that one end of the wireless apparatus main body 3, which has the antenna apparatus 2, protrudes from the electronic apparatus 11. With the wireless apparatus 1, a predetermined extension function and a wireless communication function are additionally provided to the electronic apparatus 11. In addition, the wireless apparatus 1 has a storage function that exchanges data and so forth with the electronic apparatus 11.

Figure 2:
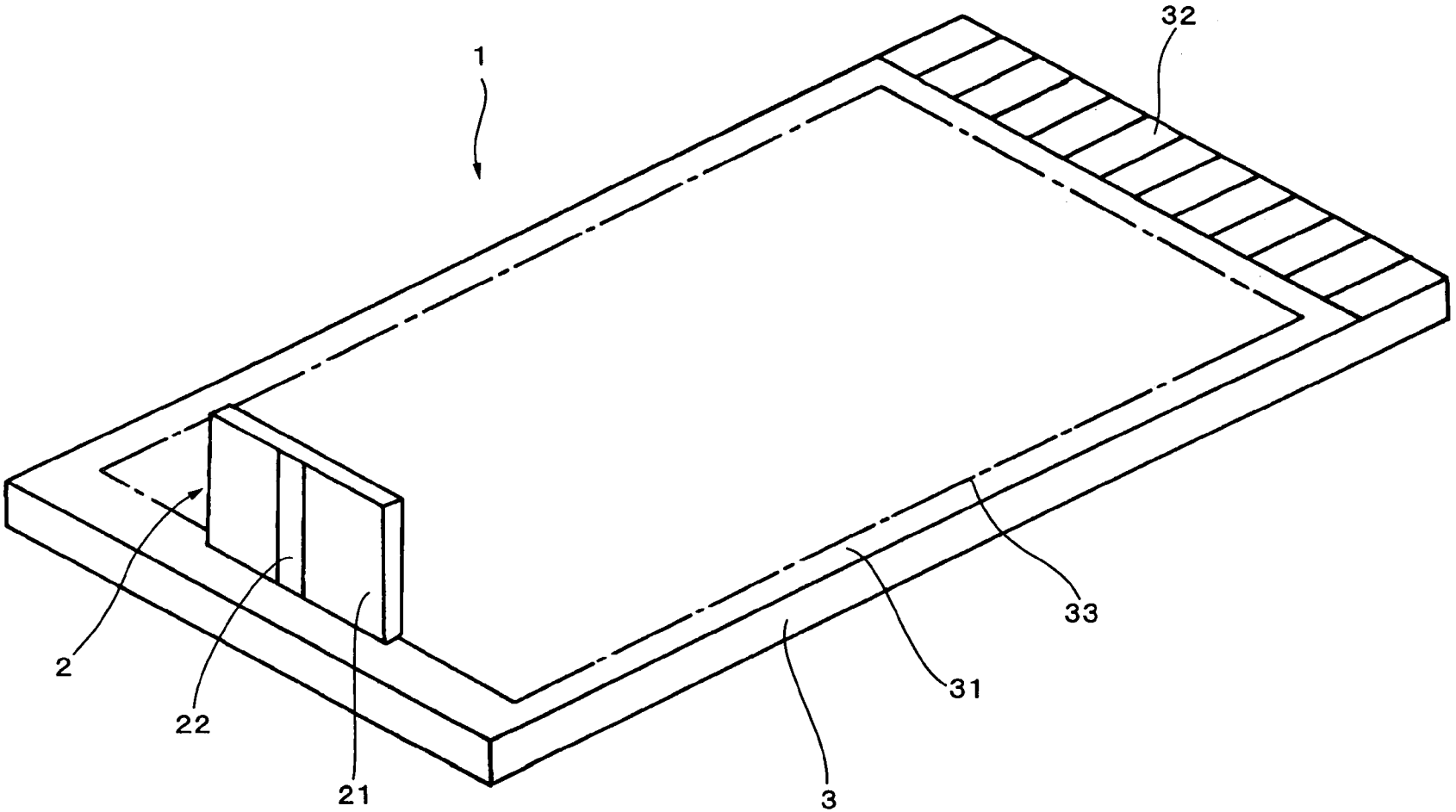
FIG. 2 is a perspective view showing an example of the wireless apparatus disposed in a housing.

FIG. 2 is a perspective view showing an example of the wireless apparatus 1 disposed in a housing. As shown in FIG. 2, the wireless apparatus main body 3 is composed of a main body substrate 31 having a rectangle shape viewed from the above of its principal surface; a connection terminal 32 disposed on one side of the rectangle; and a circuit portion 33 disposed at a center portion of the wireless apparatus 1. The connection terminal 32 is a connector portion based on for example the PCMCIA standard. By inserting the connection terminal 32 of the wireless apparatus 1 into the slot 12 of the electronic apparatus 11, the connection terminal 32 and a corresponding connection terminal disposed inside the slot 12 are connected. As a result, the electronic apparatus 11 is additionally provided with the wireless function. The circuit portion 33 has for example an antenna control circuit, a signal process circuit, a storage function memory device, and so forth.

The antenna apparatus 2 mainly has a planar antenna substrate 21 and a plurality of liner antennas 22 disposed on both principal surfaces of the antenna substrate 21. The antenna apparatus 2 is disposed on a side opposite to the connection terminal 32. The antenna apparatus 2 has a nearly square shape. The length of each side of the square is slightly smaller than the width of the main body substrate 31. The length of each side of the square is slightly larger than the height of the opening of the slot 12 of the electronic apparatus 11. In addition, the antenna apparatus 2 has a connection portion that connects the antenna apparatus 2 and the main body substrate 31.

Figure 3A:
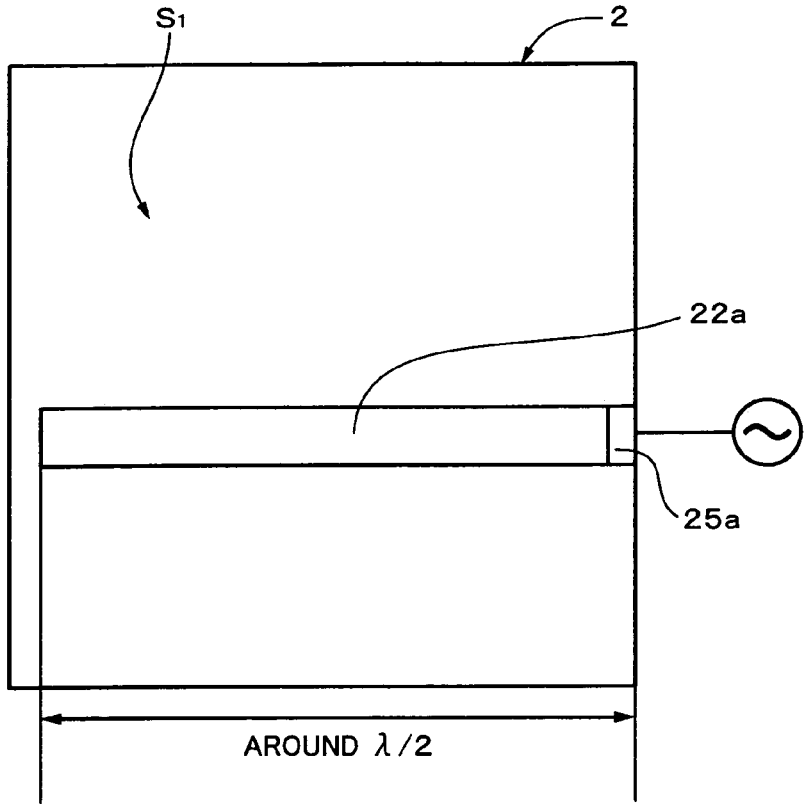
FIG. 3 is a plan view showing an antenna apparatus according to the first embodiment of the present invention.
Figure 3B:
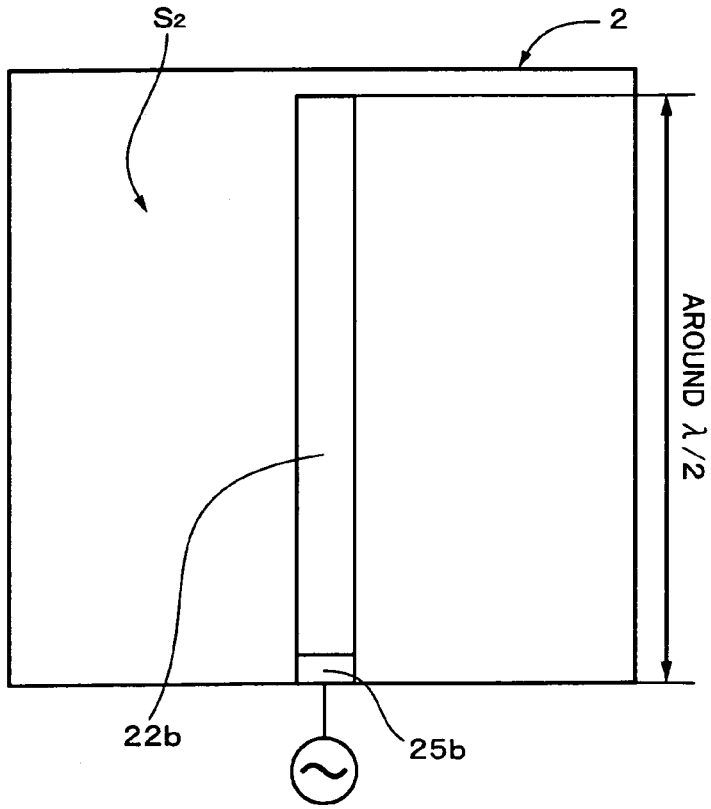

FIG. 3A is a plan view showing an example of one principal surface of the antenna apparatus 2 according to the first embodiment of the present invention. FIG. 3B is a plan view showing an example of the other principal surface of the antenna apparatus 2 according to the first embodiment of the present invention. A linear antenna 22*a* is disposed on one principal surface $S_1$ of the antenna apparatus 2. A linear antenna 22*b* is disposed on the other principal surface $S_2$ of the antenna apparatus 2 so that the linear antenna 22*b* is orthogonal to the linear antenna 22*a* and the antenna substrate 21 is interposed therebetween. Thus, the directions of electric fields (polarized waves) of the linear antenna 22*a* and the linear antenna 22*b* are orthogonal to each other. The linear antennas 22*a* and 22*b* have the same shape and their antenna length is for example around $\lambda/2$. Electrodes 25*a* and 25*b* made of copper or the like are disposed at respective single ends of the linear antennas 22*a* and 22*b*. The electrodes 25*a* and 25*b* are electrically connected to a circuit portion 33.

The linear antennas 22*a* and 22*b* correspond to different frequency bands. The frequency bands are for example 5 GHz bands, 2.4 GHz bands, milli-wave bands, micro-wave bands, UHF (Ultra High Frequency) bands, and so forth. The linear antennas 22*a* and 22*b* are for example Zepp antennas.

Figure 4:
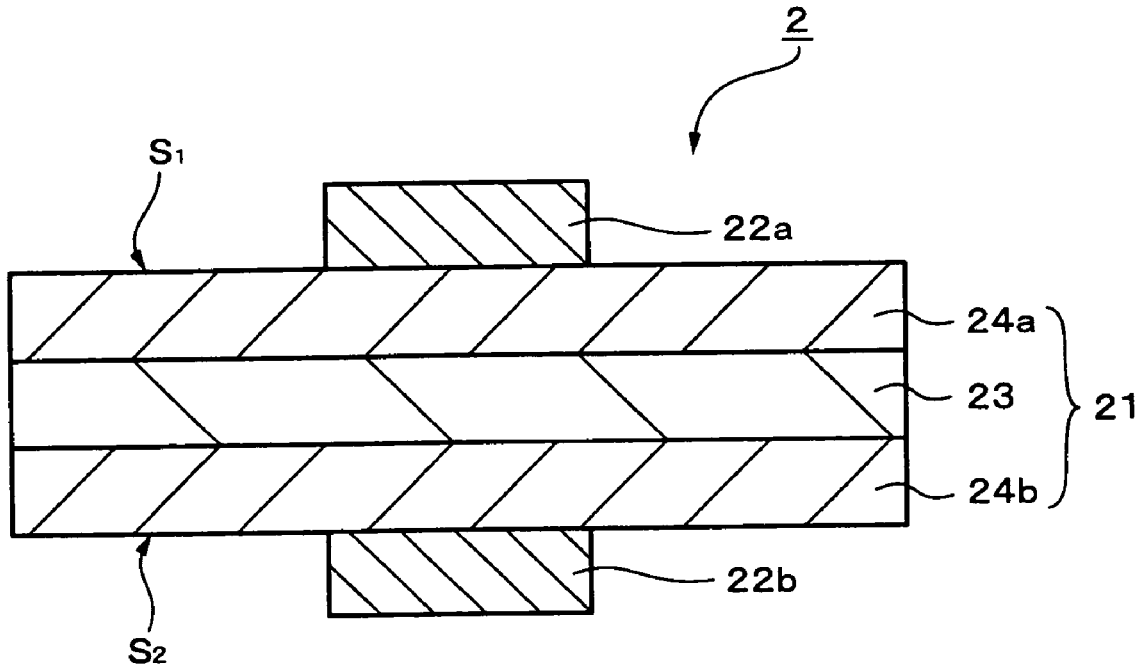
FIG. 4 is a sectional view showing an example of the structure of the antenna apparatus according to the first embodiment of the present invention.

FIG. 4 is a sectional view showing an example of the structure of the antenna substrate 21. As shown in FIG. 4, the antenna substrate 21 is composed of a solid electrolyte 24*b*, a separator 23, and a solid electrolyte 24*a* that are layered in the order. The linear antennas 22*a* and 22*b* are disposed on the solid electrolyte layers 24*a* and 24*b*, respectively.

The linear antennas 22*a* and 22*b* are made of an electroconductive plastic. When the electroconductive plastic is doped with ions, it becomes an electroconductive resin like a metal. When the electroconductive plastic is undoped, it becomes an insulative resin. As the electroconductive plastic that can be used and known is for example polyacetylene, polythiophene, polypyrrole, polyaniline, or polyazulen.

The linear antennas 22*a* and 22*b* can be, disposed for example in one of the following methods. As one method, molten electroconductive plastic is coated on the solid electrolyte layers 24*a* and 24*b* for desired linear antennas and then hardened. As another method, after molten electroconductive plastic is shaped in desired antenna patterns and hardened, they are disposed on the solid electrolyte layers 24*a* and 24*b*. As another method, film-shaped electroconductive plastic is formed by electrolytic polymerization. The electroconductive plastic is cut or punched out in desired shapes and disposed on the solid electrolyte layers 24*a* and 24*b*.

It is preferred that the linear antennas 22*a* and 22*b* be stably secured on the solid electrolyte layers 24*a* and 24*b*, respectively. As an example of a stably securing method, the linear antennas 22*a* and 22*b* are adhered to the solid electrolyte layers 24*a* and 24*b*, respectively, with an adhesive agent. As another example, the linear antennas 22*a* and 22*b* are coated with a sheet. As another example, concave portions corresponding to the shapes of the linear antennas 22*a* and 22*b* are formed in the solid electrolyte layers 24*a* and 24*b*, respectively. The linear antennas 22*a* and 22*b* are fit to the concave portions. As another example, several positions of the linear antennas 22*a* and 22*b* are secured to the solid electrolyte layers 24*a* and 24*b* with securing members or the like. As another example, these methods may be combined. When the linear antennas 22*a* and 22*b* are adhered to the solid electrolyte layers 24*a* and 24*b* with an adhesive agent, the thickness of the adhesive agent needs to be decreased so that ions can easily migrate. In addition, it is preferred that the linear antennas 22*a* and 22*b* and the solid electrolyte layers 24*a* and 24*b* be adhered at several positions with an adhesive agent so that ions are not prevented from migrating. Instead, it is preferred that the linear antennas 22*a* and 22*b* and the sold electrolyte layers 24*a* and 24*b* be adhered at several positions so that ions are not prevented from migrating between the solid electrolyte layers 24*a* and 24*b* and the linear antennas 22*a* and 22*b*. When the linear antennas 22*a* and 22*b* are secured to the solid electrolyte layers 24*a* and 24*b* with securing members or the like, it is preferred that easily peelable portions of the linear antennas 22*a* and 22*b* be secured. In addition, it is preferred that the material of the sheet that coats the linear antennas 22*a* and 22*b* be a material that is free of deterioration of radio wave characteristics thereof and that has flexibility. The material of the sheet is for example polycarbonate (PC), acrylonitorile-butadiene-styrene (ABS), or polyimide.

The solid electrolyte layers 24*a* and 24*b* have a nearly square shape. The solid electrolyte, which composes the solid electrolyte layers 24*a* and 24*b*, contains ions (dopants) that are doped to an electroconductive plastic. These ions are cations or anions. The solid electrolyte, which composes the solid electrolyte layers 24*a* and 24*b*, are for example a solid electrolyte used for battery cells such as lithium ion battery cells (lithium polymer battery cells), and fuel battery cells.

Specifically, the solid electrolytic, which composes the solid electrolyte layers 24*a* and 24*b*, may be an inorganic electrolyte, a polymer electrolyte, or a gel-type electrolyte of which an electrolyte is mixed with a highly polymerized compound. The gel-type electrolyte is composed of for example a plasticizing agent containing lithium salt and 2% to 30% by percent of a matrix polymer. At this point, an ester group, an ether group, a carbonate group, or the like may be used as a plasticizing agent or one component of a plasticizing agent.

As a polymeric material of the solid electrolyte, for example silicon gel, acrylic gel, a polysaccharide group polymer, acrylonitrile gel, polyphosphazen denatured polymer, polyethylene oxide, polypropylene oxide, a composite polymer thereof, a cross-linked polymer thereof, a denatured polymer thereof, or a fluorinated polymer, such as poly (vinylidene fluororide), poly(vinylidene fluororide-co-hexafluoropropylene), poly(vinylidene fluororide-co-tetrafluoropropylene), poly(vinylidene fluororide-co-trifluoropropylene), or a mixture thereof can be used.

The electrolyte salt is for example lithium salt or sodium salt. The lithium salt is for example a regular lithium salt used for an electrolytic solution of a regular battery cell. The lithium-salt is for example as follows, but not limited thereto.

The lithium salt is for example lithium chloride, lithium bromide, lithium iodide, lithium chlorate, lithium perchlorate, lithium bromate, lithium iodate, lithium nitrate, tetrafluoro lithium borate, hexafluoro lithium phosphate, lithium acetate, bis(trifluoro methane sulfonyl) imidolithium, $LiAsF_6$, $LiCF_3SO_3$, $LiC(SO_2CF_3)_3$, $LiAlCl_4$, $LiSiF_6$, or the like. A single compound or a mixture of two or more compounds of these lithium compounds may be used.

The separator 23 has a nearly square shape like the solid electrolyte layers 24*a* and 24*b*. The separator 23 is used to separate the solid electrolyte layers 24*a* and 24*b*. As the separator 23, a separator that is known for regular battery cells can be used. Specifically, the separator 23 is for example a porous film made of a polyolefin type material such as polypropylene or polyethylene; a porous film made of an inorganic material such as a nonwoven substance of a ceramic material; or a laminate of two or more types of these materials. In consideration of the strength of the antenna substrate 21, it is preferred that the separator 23 be disposed. However, the separator 23 may be omitted.

Figure 5:
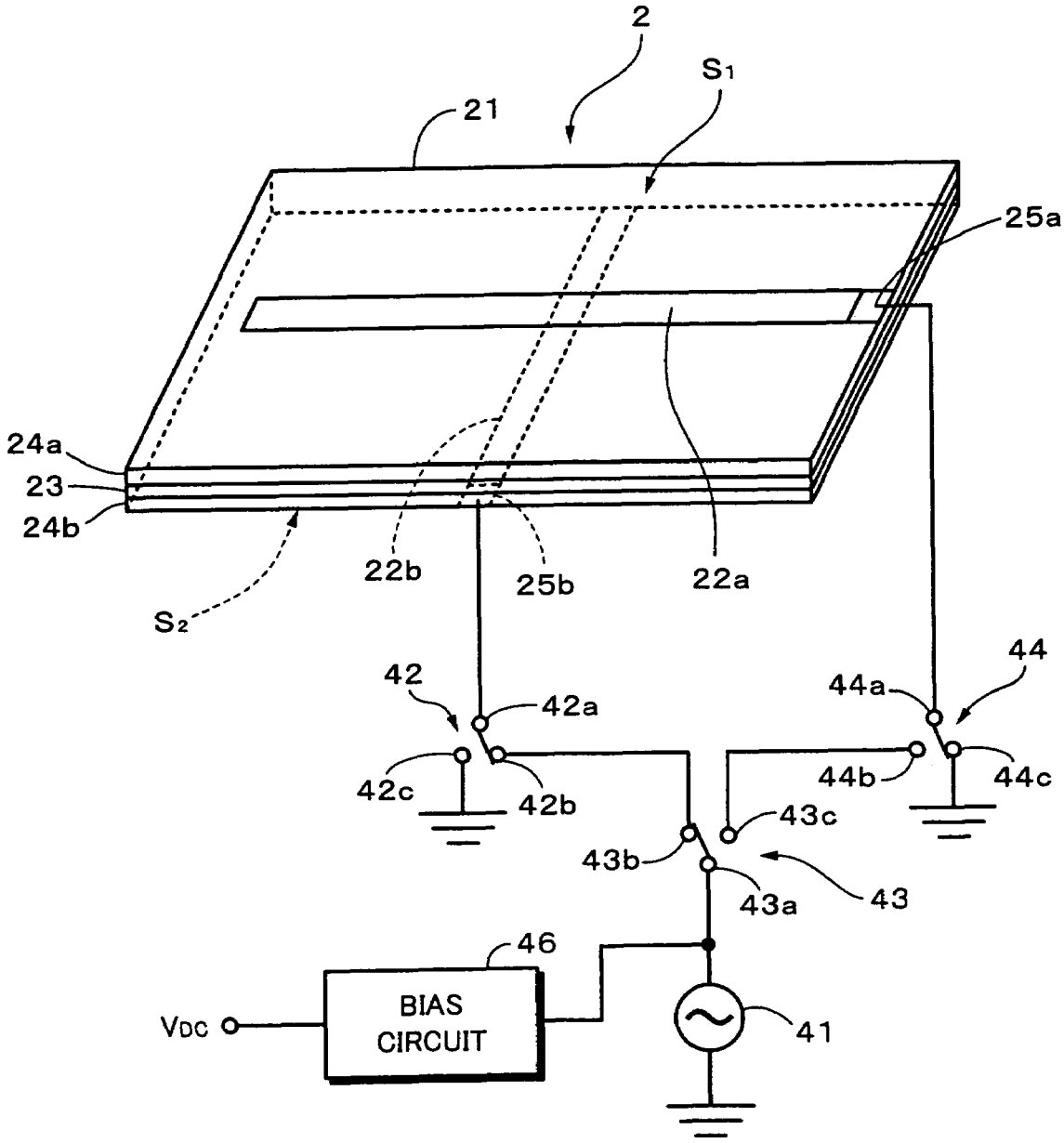
FIG. 5 is a circuit diagram showing an example of the structure of an antenna apparatus control circuit that controls the antenna apparatus according to the first embodiment of the present invention.

FIG. 5 is a circuit diagram showing an example of the structure of an antenna apparatus control circuit that controls the antenna apparatus 2 according to the first embodiment of the present invention. As shown in FIG. 5, the antenna apparatus control circuit mainly has switch devices 42, 43, and 44 and a bias circuit 46.

Disposed on the principal surface $S_1$ of the planer planar antenna substrate 21 is the linear antenna 22*a*. Disposed on the other principal surface $S_2$ is the linear antenna 22*b*. The linear antenna 22*a* disposed on the principal surface $S_1$ is connected to a terminal 44*a* of the switch device 44 through the electrode 25*a*. A terminal 44*c* of the switch device 44 is grounded. A terminal 44*b* of the switch device 44 is connected to a terminal 43*c* of the switch device 43. The linear antenna 22*b* disposed on the principal surface $S_2$ is connected to a terminal 42*a* of the switch device 42 through the electrode 25*b*. A terminal 42*c* of the switch device 42 is grounded. A terminal 42*b* of the switch device 42 is connected to a terminal 43*b* of the switch device 43. A terminal 43*a* of the switch device 43 is connected to a voltage source (not shown) through the bias circuit 46. Connected to the terminal 43*a* of the switch device 43 is also a radio frequency circuit block 41. A radio frequency signal is supplied from the radio frequency circuit block 41 to the terminal 43*a* of the switch device 43.

The bias circuit 46 stably applies a voltage to the antenna apparatus 2. The switch devices 42, 43, and 44 select one of the linear antennas 22*a* and 22*b* to be functioned as an antenna that transmits and receives a radio wave. Specifically, with the switch devices 42, 43, and 44, one of the linear antennas 22*a* and 22*b* is selected so that the DC voltage $V_{DC}$ is supplied to the selected linear antenna and the potential of the selected linear antenna becomes high. In addition, with these switch devices, one of the linear antennas 22*a* and 22*b* is selected so that a radio frequency wave is supplied to the selected antenna pattern. The switch devices 42, 43, and 44 are controlled with a control signal supplied from for example the electronic apparatus 11. To miniaturize the entire antenna apparatus including the switch devices 42, 43, and 44, it is preferred that the switch devices 42, 43, and 44 be semiconductor switches (switch ICs (Integrated Circuits)) or RF-MEMSs (Micro Electro Mechanical System) switches.

Next, the operation of the wireless apparatus 1 according to the first embodiment of the present invention will be described.

Figure 6:
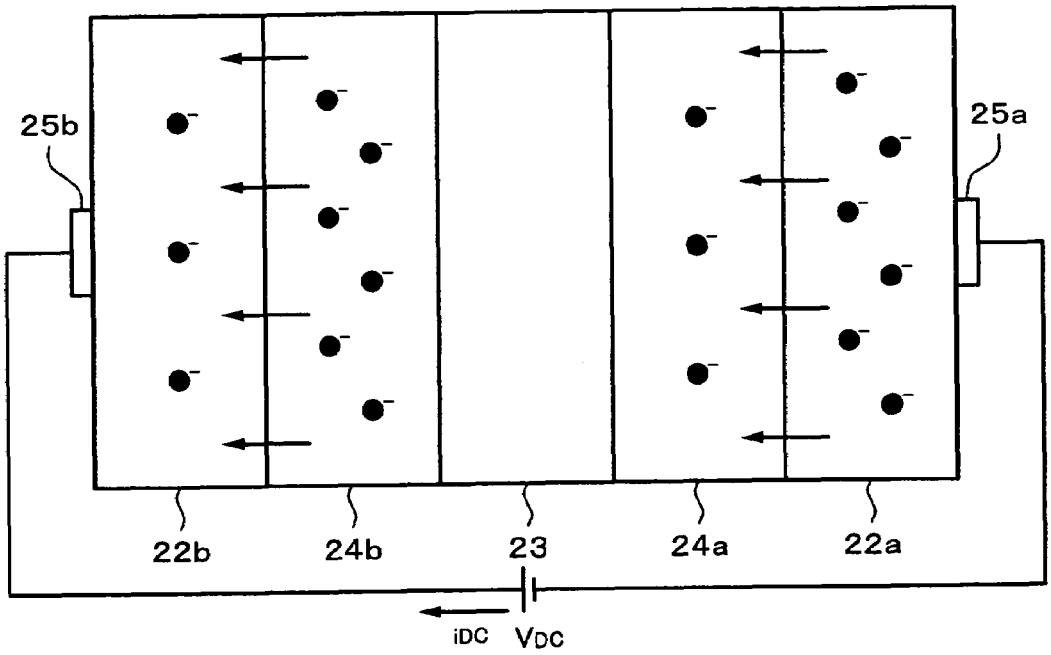
FIG. 6 is a sectional view describing an example of the operation of the wireless apparatus according to the first embodiment of the present invention.
Figure 7:
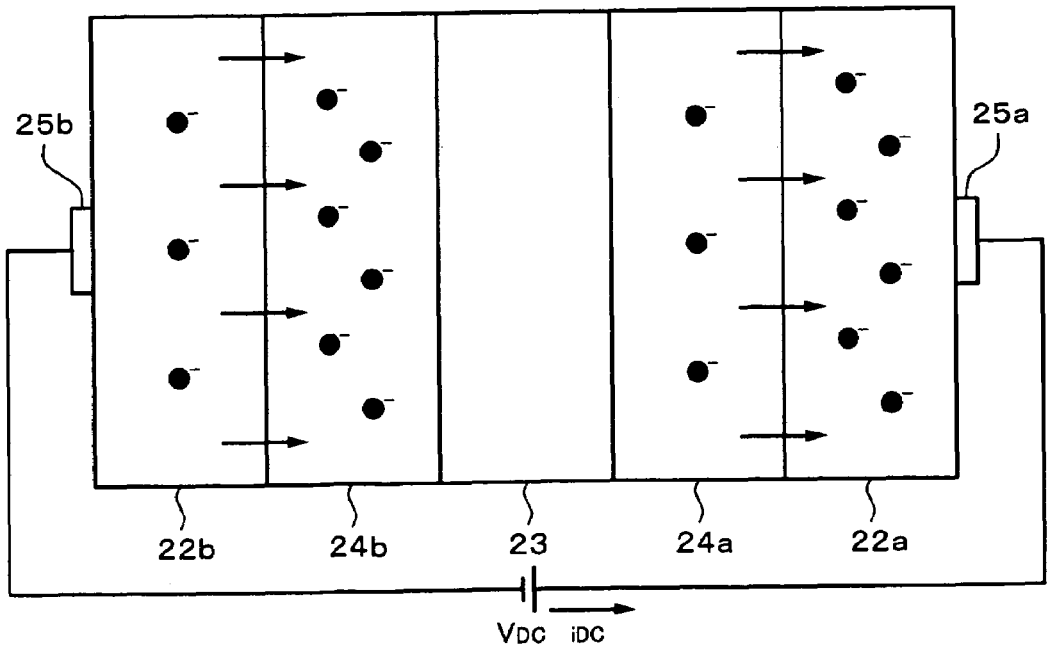
FIG. 7 is a sectional view describing an example of the operation of the wireless apparatus according to the first embodiment of the present invention.

FIG. 6 and FIG. 7 are sectional views describing an example of the operation of the wireless apparatus 1 according to the first embodiment of the present invention. Next, with reference to FIG. 5, 6 and 7, an example of the operation of the wireless apparatus 1 will be described. In this example, it is assumed that ions doped to the linear antennas 22*a* and 22*b* are anions.

First, in the antenna apparatus control circuit shown in FIG. 5, the terminals 42*a*, 43*a*, and 44*a* are connected to the terminals 42*b*, 43*b*, and 44*c*, respectively. As a result, the DC voltage $V_{DC}$ is applied to the linear antenna 22*a* so that the potential of the linear antenna 22*a* disposed on the principal surface $S_1$ becomes low and the potential of the linear antenna 22*b* disposed on the principal surface $S_2$ becomes high.

When the voltage is applied, as shown in FIG. 6, ions of the linear antenna 22*a* migrate to the solid electrolyte layer 24*a*. In contrast, ions of the solid electrolyte layer 24*b* migrate to the linear antenna 22*b*. Thus, the linear antenna 22*a* becomes an insulator, whereas the linear antenna 22*b* becomes a conductor. In other words, only the linear antenna 22*b*, which has been doped with ions, functions as an antenna. A radio wave is supplied from the radio frequency circuit block (not shown) to the linear antenna 22*b* disposed on the principal surface $S_2$.

Next, in the antenna apparatus control circuit shown in FIG. 5, the terminals 42*a*, 43*a*, and 44*a* are connected to the terminals 42*c*, 43*c*, and 44*b*, respectively. Thus, the DC voltage $V_{DC}$ is applied to the antenna apparatus 2 so that the potential of the linear antenna 22*a* disposed on the principal surface $S_1$ becomes high and the potential of the linear antenna 22*b* disposed on the principal surface $S_2$ becomes low.

When the voltage is applied, as shown in FIG. 7, ions of the linear antenna 22*b* migrate to the solid electrolyte layer 24*b*. In contrast, ions of the solid electrolyte layer 24*a* migrate to the linear antenna 22*a*. Thus, the linear antenna 22*b* becomes an insulator, whereas the linear antenna 22*a* becomes a conductor. In other words, only the linear antenna 22*a*, which has been doped with ions, functions as an antenna. A radio wave is supplied from the radio frequency circuit block (not shown) to the linear antenna 22*a* disposed on the principal surface $S_1$.

According to the first embodiment of the present invention, the following effects can be obtained.

The antenna apparatus 2 has the separator 23; the solid electrolyte layers 24*a* and 24*b* disposed on both surfaces of the separator 23; and the linear antennas 22*a* and 22*b* made of an electroconductive polymer and disposed on the solid electrolyte layers 24*a* and 24*b*, respectively. When the DC voltage $V_{DC}$ is applied between the linear antennas 22*a* and 22*b*, ions can be doped to one of the linear antennas 22*a* and 22*b*, whereas ions can be undoped from the other.

In other words, using the potential difference between the linear antennas 22*a* and 22*b*, one of the linear antennas 22*a* and 22*b* can become a conductor, whereas the other can become an insulator. Thus, in the antenna apparatus 2, where the two linear antennas 22*a* and 22*b* are closely disposed, namely, in the antenna apparatus 2, which has the antenna substrate 21, which does not have radio wave shield characteristics and is very thin, the linear antennas 22*a* and 22*b* disposed on both surfaces of the antenna substrate 21 do not interfere with each other. Thus, deterioration of the characteristic of the antenna apparatus 2 due to interference of the linear antennas 22*a* and 22*b* can be suppressed. As a result, the areas of the linear antennas 22*a* and 22*b* can be remarkably decreased. In addition, the degree of freedom of design of the antenna apparatus 2 can be remarkably improved. In other words, the antenna apparatus that selects polarized waves and that is miniaturized can be provided.

In addition, since the linear antennas 22*a* and 22*b*, which are made of an electroconductive plastic, are disposed on the solid electrolyte layers 24*a* and 24*b*, respectively, and the linear antennas 22*a* and 22*b* are actively selected from one to the other with a DC current, unlike the case that a plurality of linear antennas are made of a metal, even if the plurality of linear antennas 22*a* and 22*b* are closely disposed, deterioration of the characteristics of the antenna apparatus 2 due to interference of the linear antennas 22*a* and 22*b* can be suppressed.

In addition, the plurality of linear antennas 22*a* and 22*b* for different frequency bands corresponding to for example milli-wave bands, IEEE 802.11a/b/g, DTV (Digital Television) tuner, and so forth can be closely disposed. Thus, the antenna apparatus 2, which can deal with multi-frequency bands and that is miniaturized, the wireless apparatus 1 therewith, and the electronic apparatus therewith can be provided.

In addition, unlike linear antennas made of a hard metal, since the linear antennas 22*a* and 22*b* are made of a polymer, they have flexibility. Thus, the linear antennas 22*a* and 22*b* can be disposed in a wearable device. As a result, the degree of flexibility of design of the device can be improved.

In addition, with the switch devices 42, 43, and 44, one of the linear antennas 22*a* and 22*b* to be functioned can be selected. In addition, the plurality of linear antennas 22*a* and 22*b* disposed on the antenna substrate 21 can be freely controlled corresponding to desired frequency characteristics.

Moreover, in the polarization diversity and MIMO (Multi Input Multi Output) transmission, since propagation channels can be selected in space, communication performance can be improved. In addition, since the antennas 22*a* and 22*b* for different polarized waves can be closely disposed on the same substrate 21, their occupied areas can be decreased.

Next, a second embodiment of the present invention will be described. According to the first embodiment, the linear antennas 22*a* and 22*b* are disposed on the respective principal surfaces of the antenna apparatus 2. However, according to the second embodiment, a linear antenna and a slot antenna are disposed on one principal surface of an antenna apparatus 2.

Figure 8A:
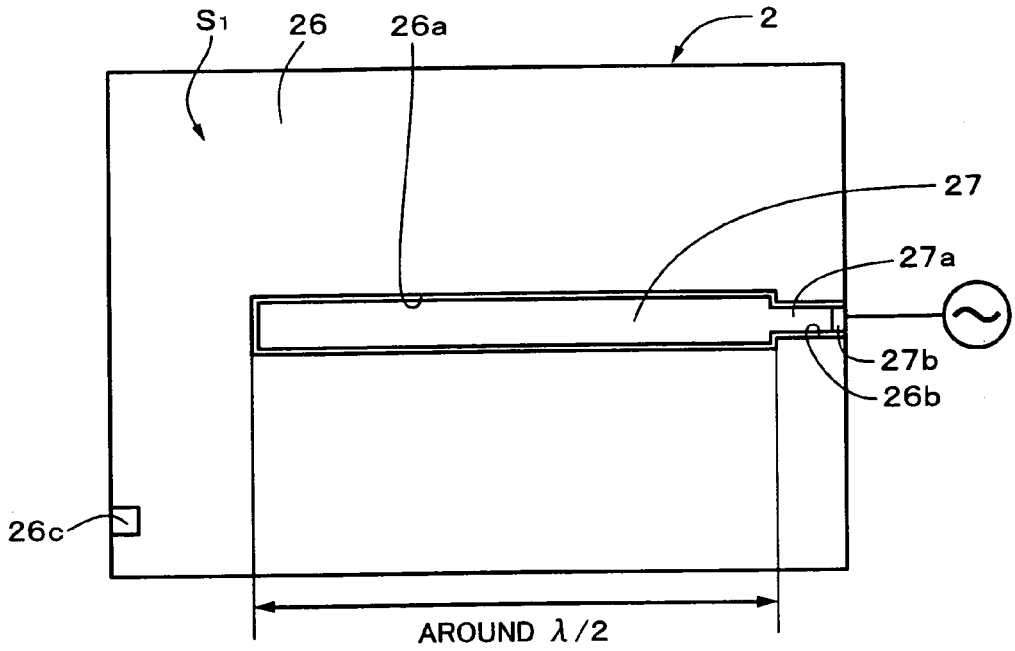
FIG. 8 is a plan view showing one principal surface of an antenna apparatus according to a second embodiment of the present invention.
Figure 8B:
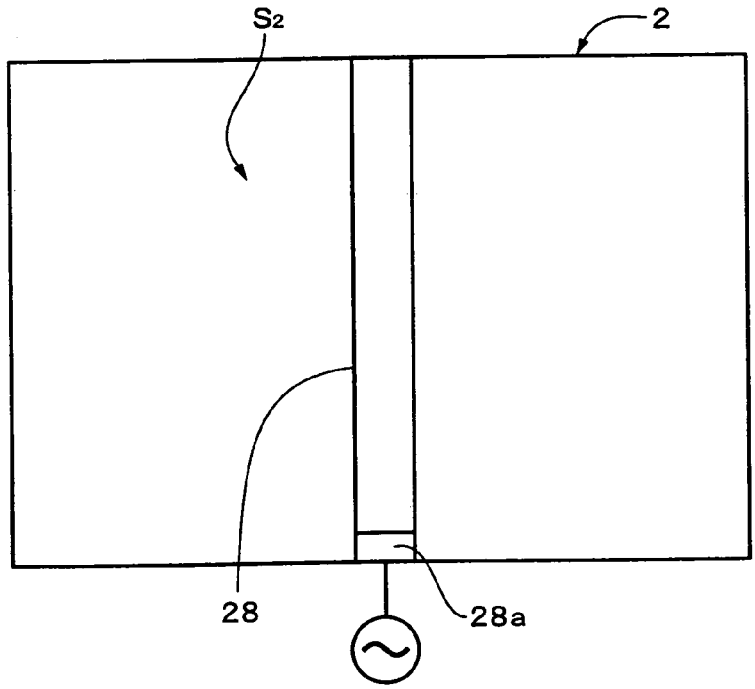

FIG. 8A is a plan view showing an example of a principal surface of the antenna apparatus according to the second embodiment of the present invention. FIG. 8B is a plan view showing an example of the other principal surface of the antenna apparatus according to the second embodiment of the present invention. Disposed on the principal surface $S_1$ of the antenna apparatus 2 are a slot antenna 26 and a linear antenna 27. Disposed on the other principal surface $S_2$ of the antenna apparatus 2 is a feeder line (micro-strip line) 28.

The slot antenna 26 has a nearly square shape like the antenna substrate 21. The slot antenna 26 has a strip shape slot 26*a* at the center. The width of the slot 26*a* is for example around $\lambda/2$. In addition, a cut portion 26*b* that has a linear cut shape is formed at one end in the longitudinal direction of the slot 26*a*. It is preferred that the width of the cut portion 26*b* be 0.1 mm or less.

In the slot 26*a*, the linear antenna 27 that has a shape corresponding to the slot antenna 26 is disposed so that the linear antenna 27 does not contact the slot antenna 26. The linear antenna 27 is for example a Zepp antenna whose antenna length is nearly around λ/2.

Connected to one end of the linear antenna 27 is a thin line portion 27*a* that extends to the outer periphery of the antenna apparatus 2 through the cut portion 26*b* so that the thin line portion 27*a* does not contact the slot antenna 26. In other words, connected to one end of the linear antenna 27 is the thin line portion 27*a* that extends in a thin line shape in the longitudinal direction of the linear antenna 27. The thin line portion 27*a* is disposed in the cut portion 26*b* so that the thin line portion 27*a* does not contact the slot antenna 26. It is preferred that the width of the thin line portion 27*a* be 0.1 mm or less. An electrode 26*c* is disposed on the slot antenna 26. An electrode 27*b* is disposed on the linear antenna 27. The electrodes 26*c* and 27*b* are connected to an antenna apparatus control circuit that will be described later. The electrodes 26*c* and 27*b* are made of a metal for example copper.

The feeder line 28 is disposed on the principal surface $S_2$ so that the feeder line 28 is orthogonal to the linear antenna 27 and the antenna substrate 21 is interposed therebetween. Disposed at one end of the feeder line 28 is an electrode 28*a*. The electrode 28*a* is made of a metal for example copper.

The slot antenna 26, the linear antenna 27, and the feeder line 28 are made of an electroconductive plastic. The electroconductive plastic is for example the same as that used in the first embodiment.

Figure 9:
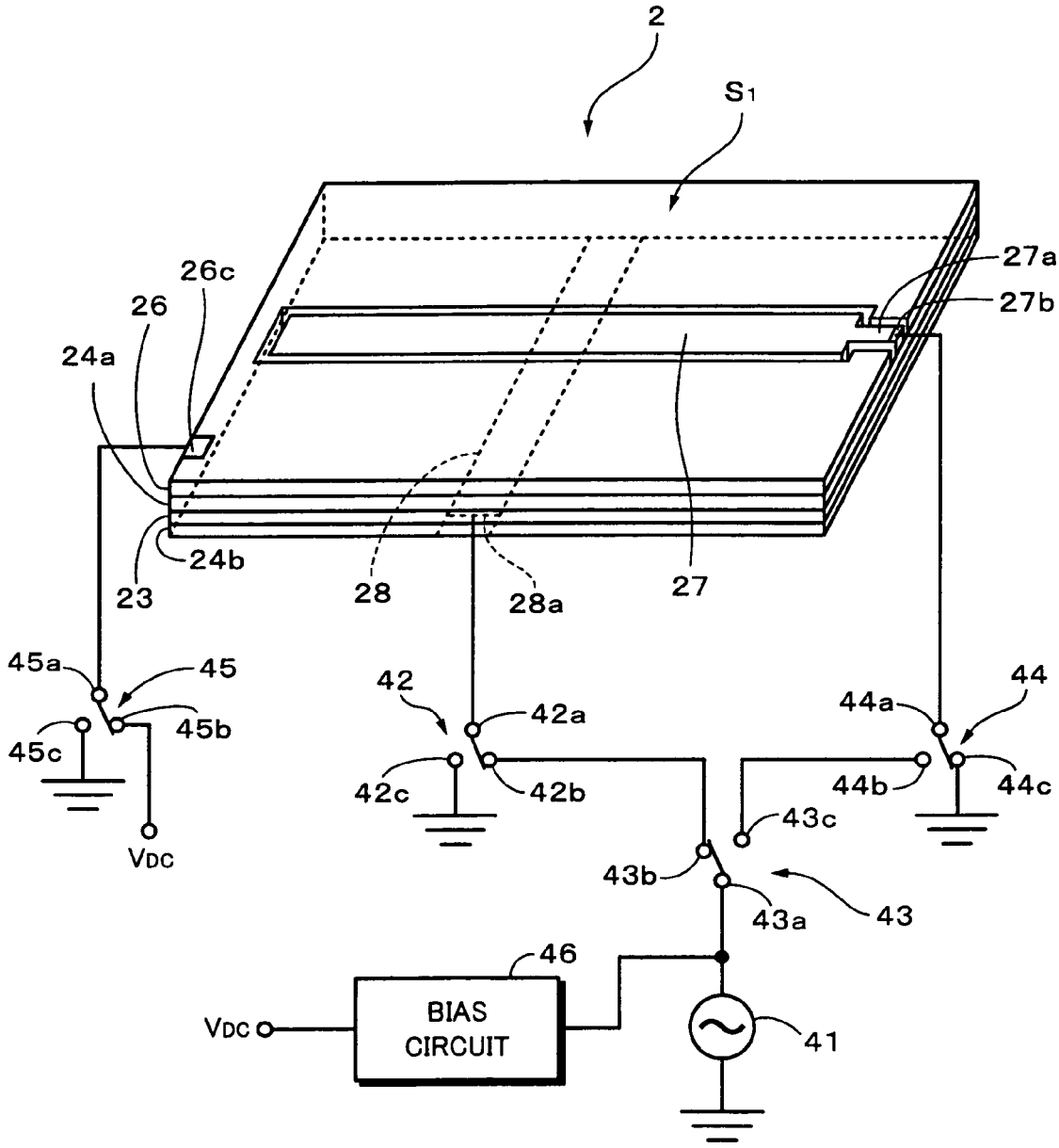
FIG. 9 is a circuit diagram showing an example of the structure of an antenna apparatus control circuit that controls the antenna apparatus according to the second embodiment of the present invention.

FIG. 9 is a circuit diagram showing an example of the structure of the antenna apparatus control circuit that controls the antenna apparatus 2 according to the second embodiment of the present invention. As shown in FIG. 9, the antenna apparatus control circuit mainly has switch devices 42, 43, 44, and 45 and a bias circuit 46.

The slot antenna 26 is connected to a terminal 45*a* of the switch device 45 through the electrode 26*c*. A terminal 45*c* of the switch device 45 is grounded. A terminal 45*b* of the switch device 45 is connected to a voltage source (not shown). A narrow line portion 27*b* of a linear antenna 27*c* is connected to a terminal 44*a* of the switch device 44 through an electrode 27*c*. A terminal 44*c* of the switch device 44 is grounded. A terminal 44*b* of the switch device 44 is connected to a terminal 43*c* of the switch device 43. The feeder line 28 is connected to a terminal 42*a* of the switch device 42 through the electrode 28*a*. A terminal 42*c* of the switch device 42 is grounded. A terminal 42*b* of the switch device 42 is connected to a terminal 43*b* of the switch device 43. A terminal 43*a* of the switch device 43 is connected to a voltage source (not shown) through the bias circuit 46. Connected to the terminal 43*a* of the switch device 43 is also a radio frequency circuit block 41. A radio frequency signal is supplied from the radio frequency signal circuit block 41 to the terminal 43*a* of the switch device 43.

Next, the operation of the wireless apparatus 1 according to the second embodiment of the present invention will be described.

Figure 10A:
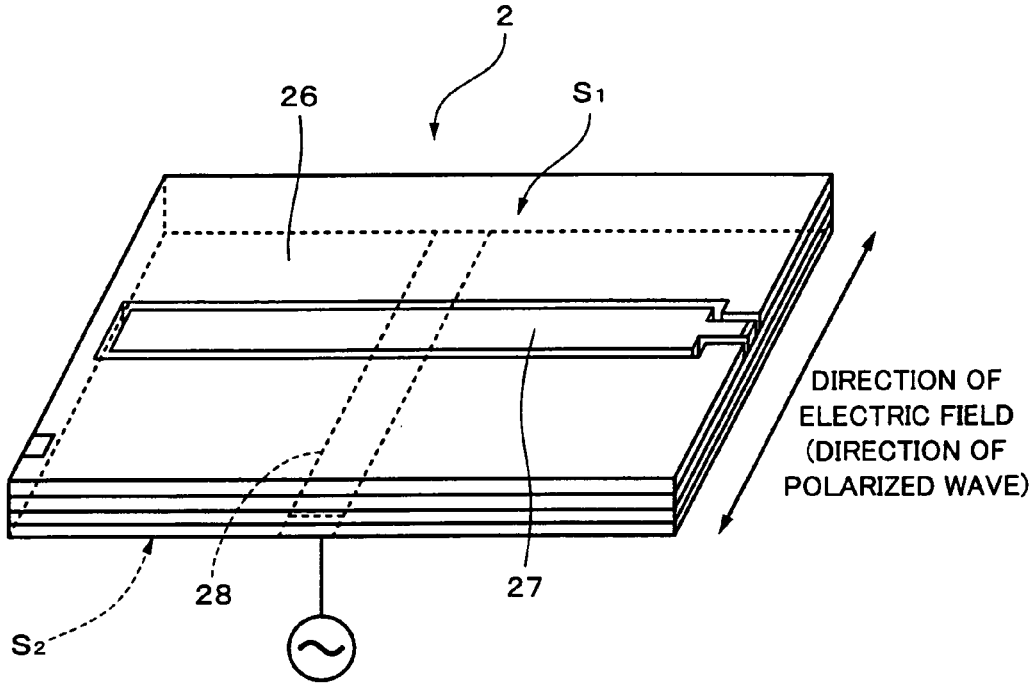
FIG. 10 is a schematic diagram showing directions of electric fields (directions of polarized waves) of the antenna apparatus according to the second embodiment of the present invention.
Figure 10B:
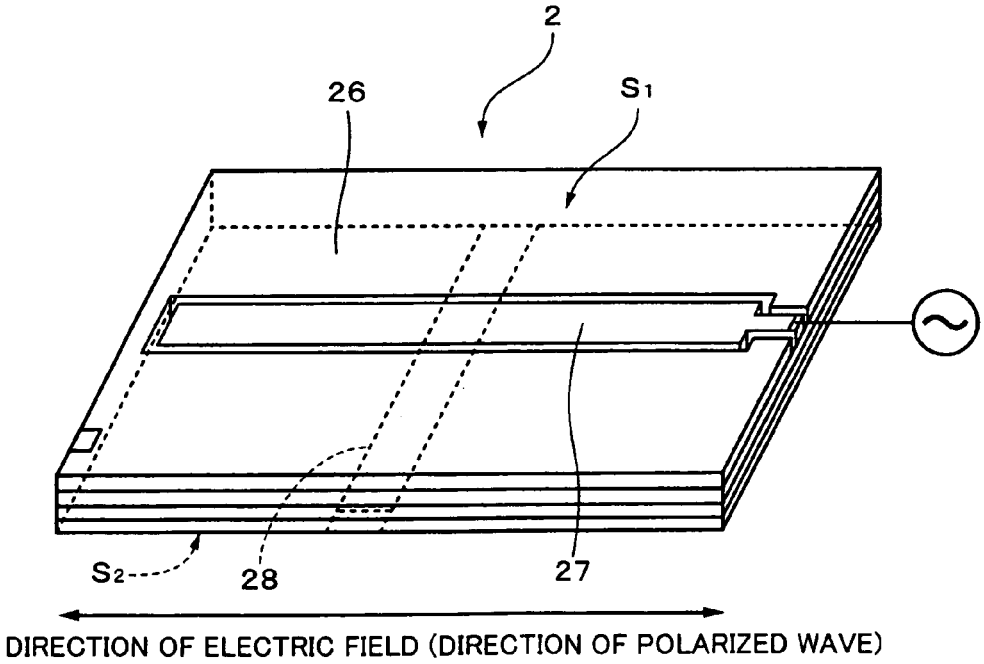

FIG. 10 is a schematic diagram showing the directions of electric fields (polarized waves) of the antenna apparatus 2 according to the second embodiment of the present invention. Next, with reference to FIG. 9 and FIG. 10, the operation of the wireless apparatus 1 will be described.

First, the terminals 42*a*, 43*a*, 44*a*, and 45*a* are connected to the terminals 42*b*, 43*b*, 44*c*, and 45*b*, respectively. Thus, the DC voltage $V_{DC}$ is applied to the antenna apparatus 2 so that the potentials of the slot antenna 26 and the feeder line 28 become high and the potential of the linear antenna 27 becomes low.

When the voltage is applied, ions of the linear antenna 27 migrate to the solid electrolyte layer 24*a*. In contrast, ions of the solid electrolyte layer 24*a* and 24*b* migrate to the slot antenna 26 and the feeder line 28. Thus, the linear antenna 27 becomes an insulator, whereas the slot antenna 26 and the feeder line 28 become conductors. In other words, only the slot antenna 26, which has been doped with ions, functions as an antenna. In addition, a radio frequency signal is supplied to the feeder line, which became a conductor. At this point, an electric field (polarized wave) is generated in the direction shown in FIG. 10A.

Next, the terminals 42*a*, 43*a*, 44*a*, and 45*a* are connected to the terminals 42*c*, 43*c*, 44*b*, and 45*c*, respectively. Thus, the DC voltage $V_{DC}$ is applied to the antenna apparatus 2 so that the potentials of the slot antenna 26 and the feeder line 28 become low and the potential of the linear antenna 27 becomes high.

When the voltage is applied, ions of the slot antenna 26 and the feeder line 28 migrate to the solid electrolytic layers 24*a* and 24*b*. In contrast, ions of the solid electrolyte layer 24*a* migrate to the linear antenna 27. Thus, the linear antenna 27 becomes a conductor, whereas the slot antenna 26 and the feeder line 28 become insulators. In other words, only the linear antenna 27, which has been doped with ions, functions as an antenna. A radio frequency wave is supplied to the linear antenna 27, which became a conductor. At this point, an electric field (polarized wave) is generated in the direction shown in FIG. 10B.

Since the rest of the operation of the wireless apparatus 1 of the second embodiment is almost the same as that of the first embodiment, the description will be omitted.

According to the second embodiment of the present invention, the following effects can be obtained.

The separator 23, the solid electrolyte layer 24*a*, and the slot antenna 26 are successively layered on one principal surface of the solid electrolyte layer 24*b*. The linear antenna 27 is disposed in the slot 26*a* of the slot antenna 26 so that the linear antenna 27 does not contact the slot antenna 26. The feeder line 28 is disposed on the other principal surface of the solid electrolyte layer 24*b*. When the DC voltage $V_{DC}$ is applied between the slot antenna 26 and the linear antenna 27, ions can be doped to one of the slot antenna 26 and the linear antenna 27 and ions can be undoped from the other. In other words, using the potential difference between the slot antenna 26 and the linear antenna 27, one of the slot antenna 26 and the linear antenna 27 can become a conductor and the other can become an insulator. Thus, the areas for the slot antenna 26 and the linear antenna 27 can be remarkably decreased without deterioration of characteristics of the antenna apparatus 2 due to interference of the slot antenna 26 and the linear antenna 27. Thus, the slot antenna 26 and the linear antenna 27 can be more easily disposed in an electronic apparatus or the like. The other effects of the second embodiment are the same as the effects of the first embodiment.

Next, a third embodiment of the present invention will be described. In the first and second embodiments, examples of which two antenna patterns are disposed in the antenna apparatus 2 were described. In contrast, according to the third embodiment, an example of which three or more antenna patterns are disposed in the antenna apparatus 2 will be described.

Figure 11:
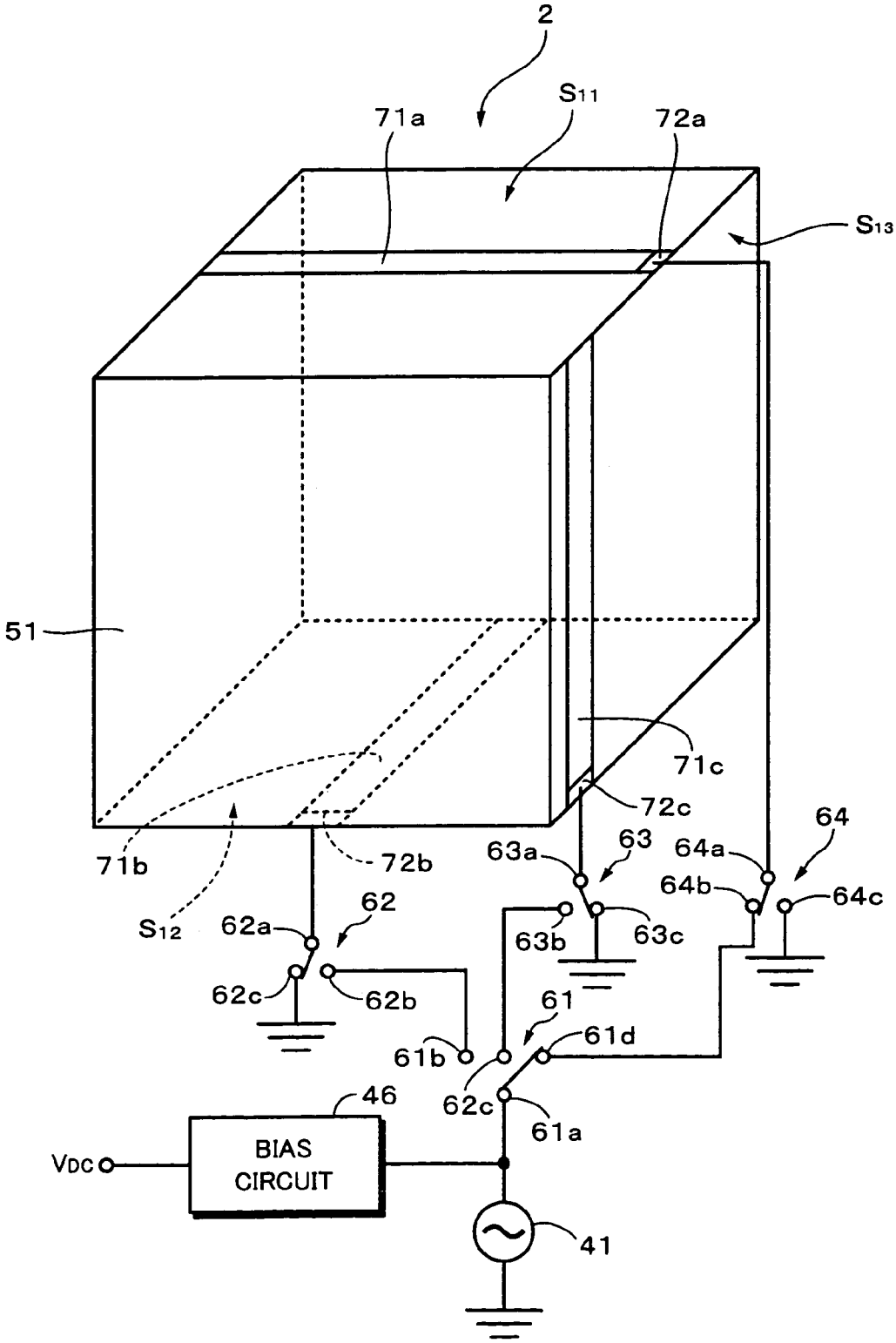
FIG. 11 is a circuit diagram showing an example of the structure of an antenna apparatus according to a third embodiment of the present invention and an antenna apparatus control circuit that controls the antenna apparatus.

FIG. 11 shows an example of the structure of an antenna apparatus 2 according to the third embodiment and an antenna apparatus control circuit that controls the antenna apparatus 2. As shown in FIG. 11, the antenna apparatus 2 is mainly composed of a substrate 51 that has a cubic shape; and three antenna patterns 71*a*, 71*b*, and 71*c* disposed on surfaces of the substrate 51. For convenience sake, the three antenna patterns 71*a*, 71*b*, and 71*c* are disposed on the substrate 51, which has a cubic shape. However, it should be appreciated that the present invention can be applied to the case that there are four or more antenna patterns 71 on the substrate 51. For example, six antenna patterns 71 may be disposed on the respective surfaces of the substrate 21.

The antenna pattern 71*a* is disposed on a surface $S_{11}$ of the substrate 51. The antenna pattern 71*b* is disposed on a surface $S_{12}$ that is opposite to the surface $S_{11}$. Specifically, the antenna pattern 71*b* is disposed so that it is orthogonal to the direction of the electric field (direction of the polarized wave) of the antenna pattern 71*a*.

The antenna pattern 71*c* is disposed on a surface $S_{13}$ adjacent to the surface $S_{11}$ and the surface $S_{12}$. Specifically, the antenna pattern 71*c* is disposed so that it is orthogonal to the directions of electric fields (directions of polarized waves) of the antenna patterns 71*a* and 71*b*. In other words, the directions of electric fields (directions of polarized waves) of the antenna patterns 71*a*, 71*b*, and 71*c* are orthogonal to each other.

The substrate 51 is made of a solid electrolyte. The solid electrolyte is the same as that of the first embodiment. The antenna patterns 71*a*, 71*b*, and 71*c* are for example linear antennas and slot antennas. The linear antennas are for example Zepp antennas. The antenna patterns 71*a*, 71*b*, and 71*c* may be a combination of at least one linear antenna and at least one slot antenna. For example, two antenna patterns of the antenna patterns 71*a*, 71*b*, and 71*c* may be linear antennas and the other antenna may be a slot antenna.

In addition, as shown in FIG. 11, the antenna apparatus control circuit has switch devices 61, 62, 63, and 64 and a bias circuit 46. The antenna pattern 71*a* disposed on the surface $S_{11}$ is connected to a terminal 64*a* of the switch device 64. A terminal 64*c* of the switch device 64 is grounded. A terminal 64*b* of the switch device 64 is connected to a terminal 61*d* of the switch device 61. The antenna pattern 71*b* disposed on the surface $S_{12}$ is connected to a terminal 62*a* of the switch device 62. A terminal 62*c* of the switch device 62 are grounded. A terminal 62*b* of the switch device 62 is connected to a terminal 61*b* of the switch device 61. An antenna pattern 71*c* disposed on the surface $S_{13}$ is connected to a terminal 63*a* of the switch device 63. A terminal 63*c* of the switch device 63 is grounded. A terminal 63*b* of the switch device 63 is connected to a terminal 61*b* of the switch device 61. A terminal 61*a* of the switch device 61 is connected to a voltage source (not shown) through the bias circuit 46. In addition, connected to the terminal 61*a* of the switch device 61 is a radio frequency signal block 41. A radio frequency signal is supplied to the terminal 61*a* of the switch device 61.

The switch devices 61, 62, 63, and 64 select one of the antenna patterns 71*a*, 71*b*, and 71*c* to be functioned as an antenna through which a radio wave is transmitted and received. Specifically, with the switch devices 61, 62, 63, and 64, one of the antenna patterns 71*a*, 71*b*, and 71*c* is selected so that the DC voltage $V_{DC}$ is supplied to the selected antenna pattern and the potential of the selected antenna pattern becomes high. In addition, with these switch devices, one of the antenna patterns 71*a*, 71*b*, and 71*c* is selected so that a radio frequency wave is supplied to the selected antenna pattern. The switch devices 61, 62, 63, and 64 are controlled with a control signal supplied from for example the electronic device 11. To miniaturize the entire apparatus including the switch devices 61, 62, 63, and 64, it is preferred that the switch devices 61, 62, 63, and 64 be semiconductor switches (switch ICs (Integrated Circuits) or RF-MEMS (Micro Electro Mechanical System) switches.

Figure 12:
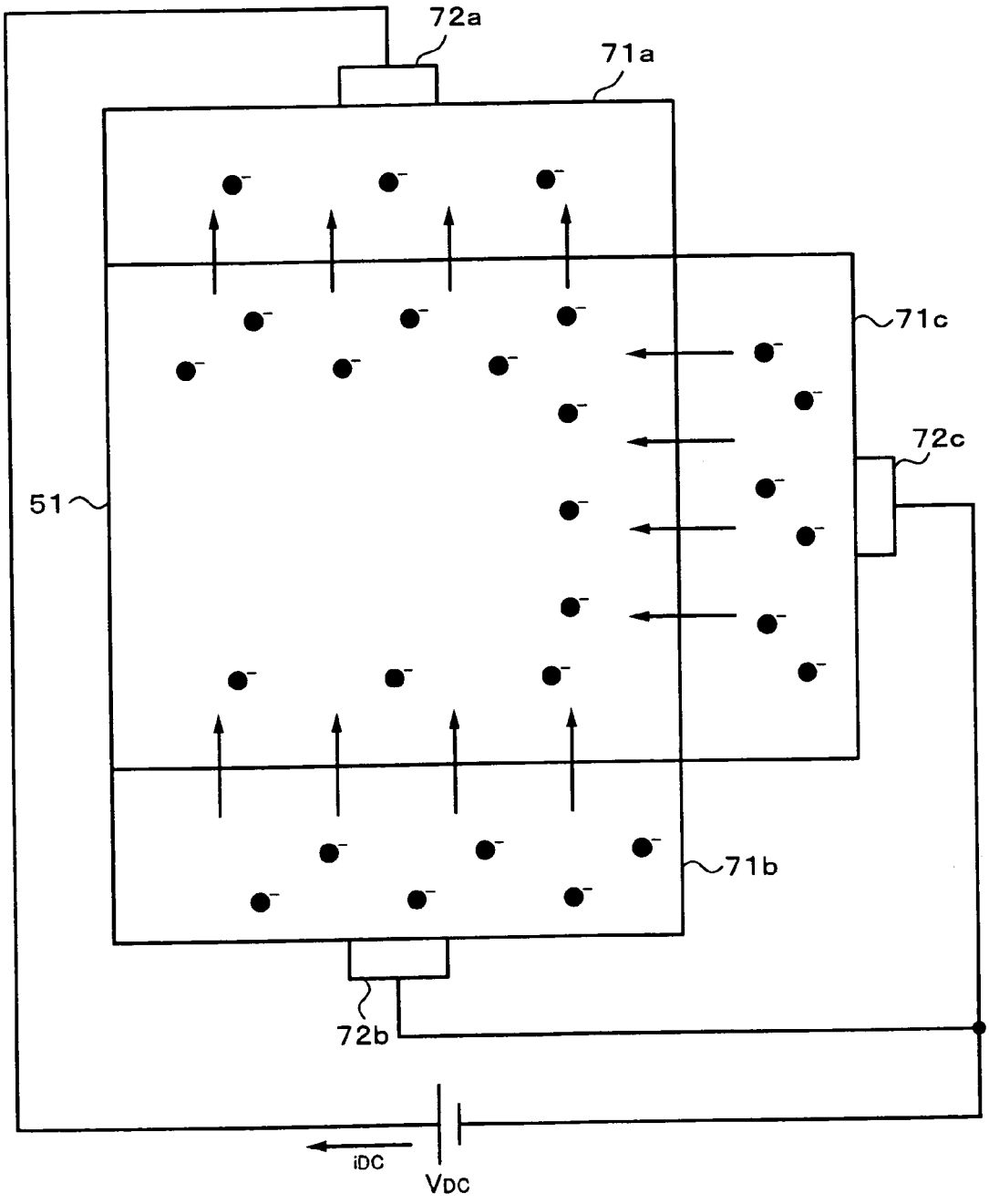
FIG. 12 is a sectional view describing an example of the operation of the wireless apparatus according to the third embodiment of the present invention.
Figure 13:
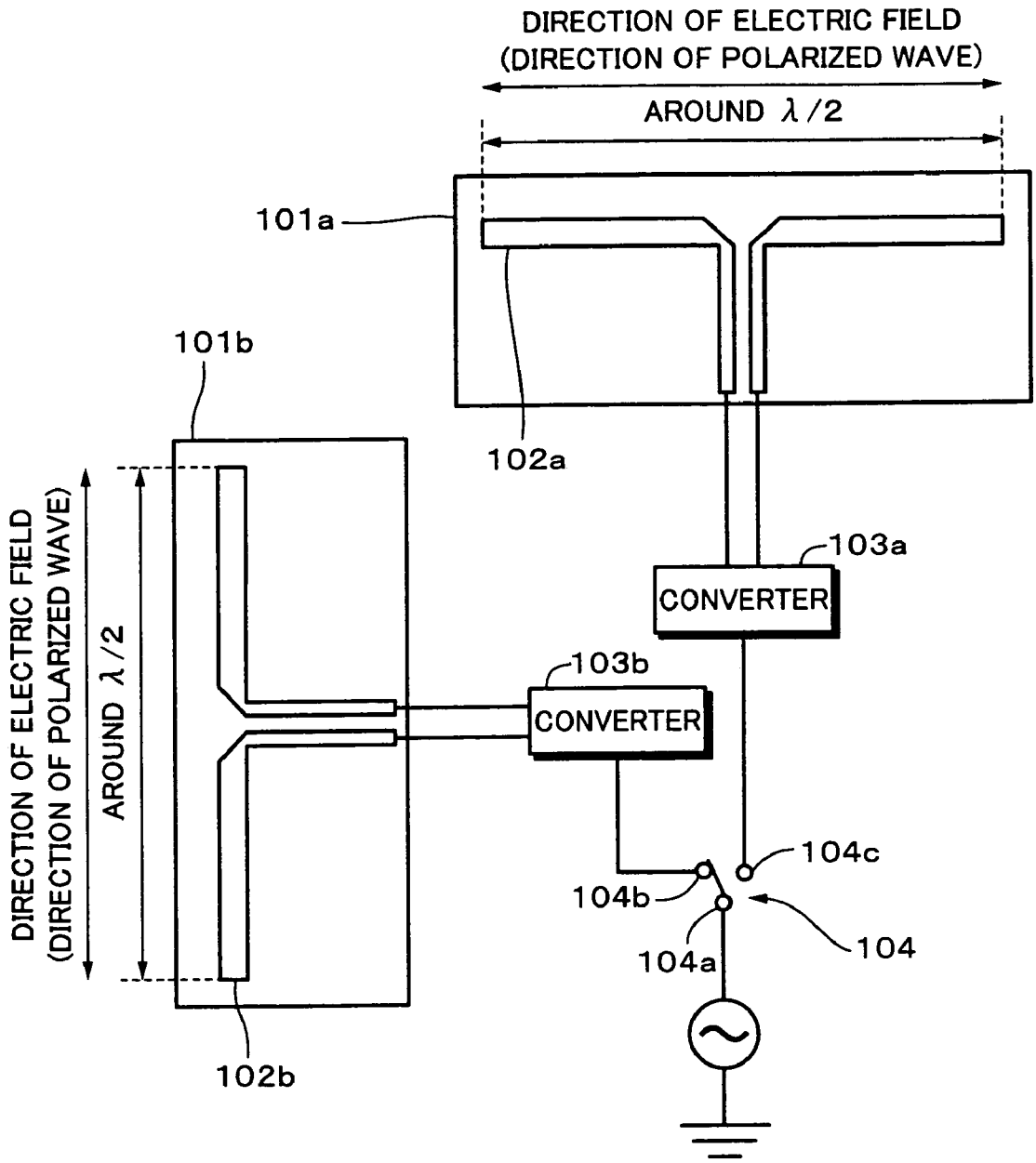
FIG. 13 is a plan view showing a diversity wireless apparatus that uses dipole antennas.
Figure 14:
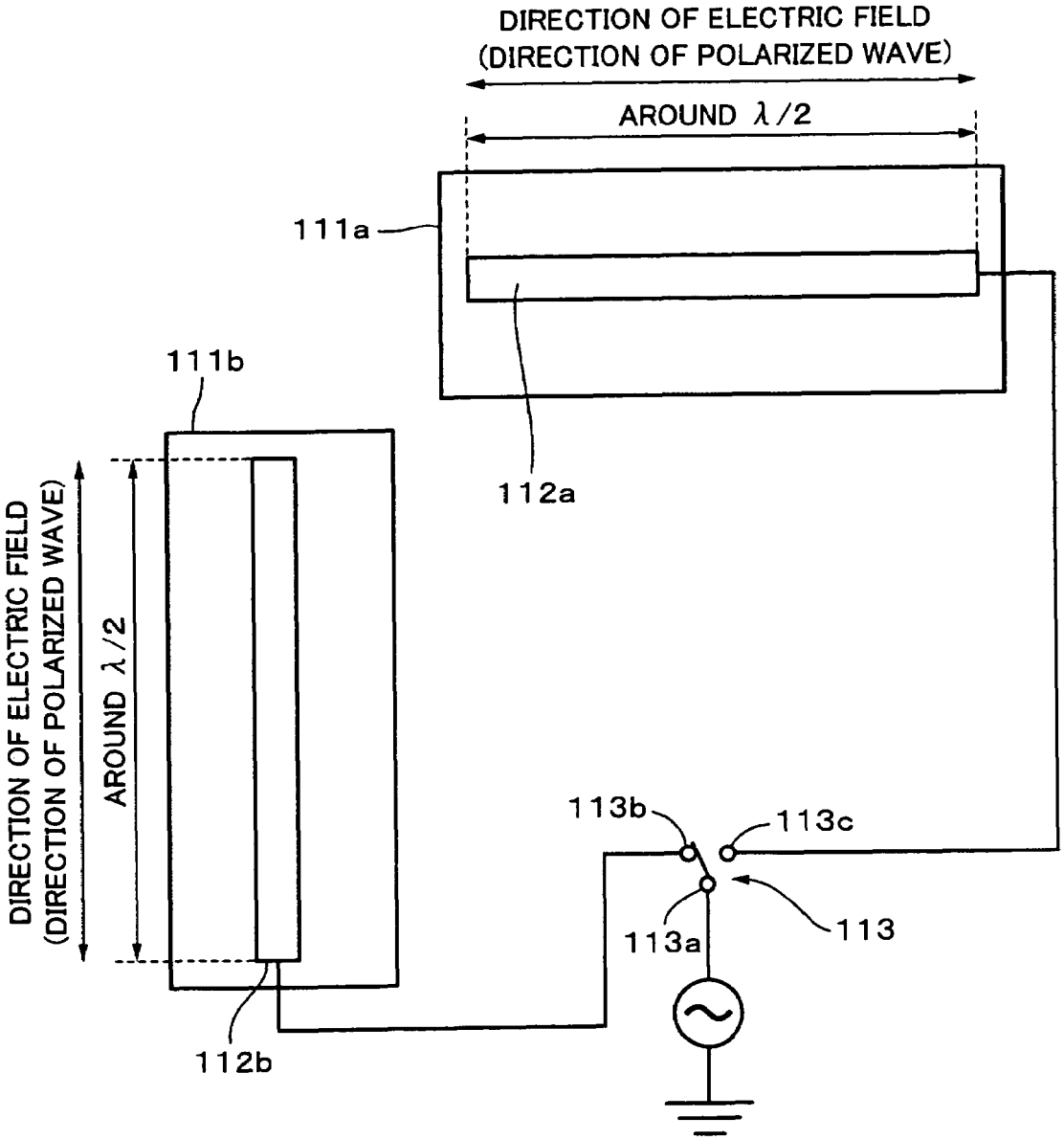
FIG. 14 is a plan view showing a diversity wireless apparatus that uses linear antennas.
Figure 15:
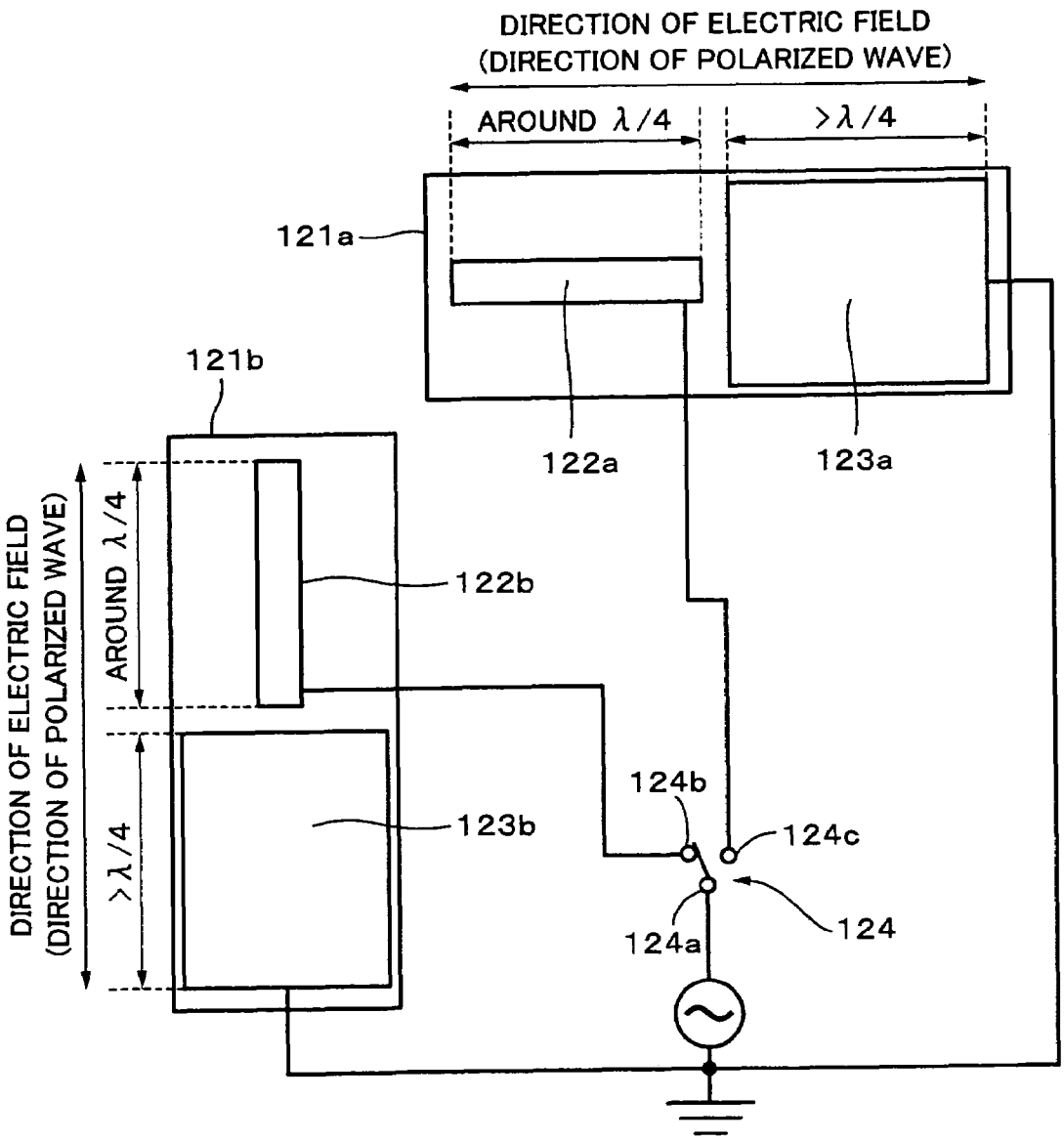
FIG. 15 is a plan view showing a diversity wireless apparatus that uses monopole antennas.

Next, the operation of the wireless apparatus 1 according to the third embodiment of the present invention will be described. FIG. 12 is a sectional view describing an example of the operation of the wireless apparatus 1 according to the third embodiment of the present invention. In this example, it is assumed that only the antenna pattern 71*a* of the antenna patterns 71*a*, 71*b*, and 71*c* is functioned as an antenna. Next, with reference to FIG. 11 and FIG. 12, an example of the operation of the wireless apparatus 1 will be described. In this example, it is assumed that ions doped to the antenna patterns 71*a*, 71*b*, and 71*c* are anions.

First, the terminals 61*a*, 62*a*, 63*a*, and 64*a* shown in FIG. 11 are connected to the terminals 61*d*, 62*c*, 63*c*, and 64*b*, respectively. Thus, a DC voltage $V_{DC}$ is applied to the antenna apparatus 2 so that the potential of the antenna pattern 71*a* becomes high and the potentials of the antenna patterns 71*b* and 71*c* become low.

When the voltage is applied, as shown in FIG. 12, ions of the antenna patterns 71*b* and 71*c* migrate to the substrate 51. Ions of the substrate 51 migrate to the antenna pattern 71*a*. Thus, the antenna patterns 71*b* and 71*c* become insulators, whereas the antenna pattern 71*a* becomes a conductor. In other words, only the antenna pattern 71*a* to which ions are doped functions as an antenna. A radio frequency signal is supplied to the antenna pattern 71*a*, which became a conductor.

Since the rest of the operation of the antenna apparatus 2 of the third embodiment is almost the same as the operation of the first embodiment, the description will be omitted.

According to the third embodiment of the present invention, the same effect as the first embodiment can be obtained.

Although the first, second, and third embodiments of the present invention were specifically described, it should be appreciated that the present invention is not limited to these embodiments, but various medications based on the technical idea of the present invention can be performed.

For example, the values and structures of the first, second, and third embodiments are just examples. Thus, values and structures different from those may be used when necessary.

In addition, according to the first, second, and third embodiments, the solid electrolyte has for example a planar shape and a cubic shape. However, the shapes of the solid electrolyte are not limited to these. Instead, the solid electrolyte may have for example a spherical shape or a polyhedral shape such as an ellipsoid shape or a cuboid shape.

In addition, according to the third embodiment, only one of a plurality of antenna patterns is doped with ions to function it as an antenna. Instead, at least two of a plurality of antenna patterns may be,doped with ions to function them as antennas. In this case, a plurality of antenna patterns need to be paired and spaced so that they do not interfere with each other.

In addition, according to the first, second, and third embodiments, the present invention is applied to the wireless apparatus 1, which can be freely attached to and detached from the electronic apparatus 11 such as a personal computer. Of course, the present invention can be applied to an electronic apparatus that has a built-in wireless communication function. For example, the present invention can be applied to a portable information device that has a built-in wireless function. In this case, since the antenna apparatus 2 can be disposed at any position, the electronic apparatus such as a portable information device can be more miniaturized.

In addition, the antenna apparatus 2 according to the first, second, and third embodiments may be adhered to the front surface of the electronic apparatus such as a portable information terminal. In this case, the space for the antenna apparatus 2 can be omitted. Thus, the electronic apparatus can be more miniaturized.

In addition, according to the first, second, and third embodiments, the present invention is applied to the wireless apparatus 1. Instead, the present invention may be applied to a wearable device.

In addition, according to the first, second, and third embodiments, a protective layer that coats the antenna patterns of the antenna apparatus 2 may be additionally disposed. The material of the protective layer needs to be a material that does not deteriorate the characteristics of radio waves of the antenna patterns. With this structure, the durability of the antenna apparatus 2 can be improved.

In addition, according to the first, second, and third embodiments, a plurality of antenna patterns corresponding to different frequency bands are closely disposed. Instead, a plurality of antenna patterns corresponding to the same frequency band, but different center frequencies may be closely disposed to widen the frequencies with which the antenna apparatus can deal.

The invention claimed is:

1. An antenna apparatus, comprising:

a substrate made of an insulator layer inserted in an electrolyte; and a plurality of antenna patterns disposed on the substrate and insulated from each other, and each of the plurality of antenna patterns is made of an electroconductive plastic and is configured to transmit and/or receive polarized waves that are orthogonal to each other, wherein one of the plurality of antenna patterns is doped with ions from the electrolyte and is configured to function as an antenna when a DC voltage is applied between said plurality of antenna patterns.

2. The antenna apparatus as set forth in claim 1, wherein the substrate has a planer shape, and wherein the plurality of antennas are disposed on both principal surfaces of the substrate.

3. The antenna apparatus as set forth in claim 2, wherein the plurality of antennas are disposed so that the substrate is interposed therebetween.

4. The antenna apparatus as set forth in claim 1, wherein the antenna patterns are linear antennas.

5. The antenna apparatus as set forth in claim 4, wherein the linear antennas are Zepp antennas.

6. The antenna apparatus as set forth in claim 1, wherein the plurality of antenna patterns are at least one linear antenna and at least one slot antenna.

7. The antenna apparatus as set forth in claim 6, wherein the linear antenna is a Zepp antenna.

8. The antenna apparatus as set forth in claim 6, wherein the linear antenna is disposed in a slot of the slot antenna.

9. The antenna apparatus as set forth in claim 1, wherein the plurality of antenna patterns are two linear antennas and one slot antenna.

10. An wireless apparatus that is connected to a main body of a device and that additionally provides a wireless function to the device, the wireless apparatus comprising:

a substrate made of an insulator layer inserted in an electrolyte;

a plurality of antenna patterns disposed on the substrate and insulated from each other, and each of the plurality of antenna patterns is made of an electroconductive plastic and is configured to transmit and/or receive polarized waves that are orthogonal to each other; and a switch that is configured to select two groups from the plurality of antenna patterns so that the first group has one potential and the second group has another potential with a DC voltage applied between the plurality of antenna patterns, wherein the first group is doped with ions from the electrolyte and is configured to function as an antenna when the DC voltage is applied between said plurality of antenna patterns.

11. The wireless apparatus as set forth in claim 10, wherein the substrate has a planer shape, and wherein the plurality of antennas are disposed on both principal surfaces of the substrate.

12. The wireless apparatus as set forth in claim 11, wherein the plurality of antennas are disposed so that the substrate is interposed therebetween.

13. The wireless apparatus as set forth in claim 10, wherein the antenna patterns are linear antennas.

14. The wireless apparatus as set forth in claim 13, wherein the linear antennas are Zepp antennas.

15. The wireless apparatus as set forth in claim 10, wherein the plurality of antenna patterns are at least one linear antenna and at least one slot antenna.

16. The wireless apparatus as set forth in claim 15, wherein the linear antenna is a Zepp antenna.

17. The wireless apparatus as set forth in claim 15, wherein the linear antenna is disposed in a slot of the slot antenna.

18. The wireless apparatus as set forth in claim 10, wherein the plurality of antenna patterns are two linear antennas and one slot antenna.

19. An electronic apparatus that has a wireless communication function that transmits and receives information, the electronic apparatus comprising:

a substrate made of an insulator layer inserted in an electrolyte;

a plurality of antenna patterns disposed on the substrate and insulated from each other, and each of the plurality of antenna patterns is made of an electroconductive plastic and is configured to transmit and/or receive polarized waves that are orthogonal to each other;

a voltage source that is configured to apply a DC voltage between the plurality of antenna patterns; and a switch that is configured to select two groups from the plurality of antenna patterns so that the first group has one potential and the second group has another potential with the DC voltage applied between the plurality of antenna patterns, wherein the first group is doped with ions from the electrolyte and is configured to function as an antenna when the DC voltage is applied between said plurality of antenna groups.

20. The electronic apparatus as set forth in claim 19, wherein the substrate has a planer shape, and wherein the plurality of antennas are disposed on both principal surfaces of the substrate.

21. The electronic apparatus as set forth in claim 20, wherein the plurality of antennas are disposed so that the substrate is interposed therebetween.

22. The electronic apparatus as set forth in claim 19, wherein the antenna patterns are linear antennas.

23. The electronic apparatus as set forth in claim 22, wherein the linear antennas are Zepp antennas.

24. The electronic apparatus as set forth in claim 19, wherein the plurality of antenna patterns are at least one linear antenna and at least one slot antenna.

25. The electronic apparatus as set forth in claim 24, wherein the linear antenna is a Zepp antenna.

26. The electronic apparatus as set forth in claim 24, wherein the linear antenna is disposed in a slot of the slot antenna.

27. The electronic apparatus as set forth in claim 19, wherein the plurality of antenna patterns are two linear antennas and one slot antenna.

* * * * *